US005660121A

United States Patent [19]

Botts et al.

[11] Patent Number: 5,660,121

[45] Date of Patent: Aug. 26, 1997

[54] FOLDING FRAMEWORK AND SUPPORT LEGS

[75] Inventors: Rollin D. Botts, Bloomington; Donald A. Shank, Rogers, both of Minn.

[73] Assignee: Sico Incorporated, Minneapolis, Minn.

[21] Appl. No.: 396,195

[22] Filed: Feb. 24, 1995

[51] Int. Cl.[6] ..... A47B 3/00

[52] U.S. Cl. ..... 108/132; 108/123; 248/188.6

[58] Field of Search ..... 108/123, 129, 108/131, 132, 173, 143; 248/188.6, 436, 439, 188.96; 5/181, 202

[56] References Cited

U.S. PATENT DOCUMENTS

| | | | |
|---|---|---|---|
| Re. 24,454 | 4/1958 | Wilson . | |
| 89,306 | 4/1869 | Goodher . | |
| D. 304,499 | 11/1989 | Rogers et al. . | |
| D. 307,186 | 4/1990 | Rogers et al. . | |
| 770,152 | 9/1904 | Bechtel . | |
| 1,370,732 | 3/1921 | Corbett . | |
| 1,585,598 | 5/1926 | Miner | 168/132 |
| 1,605,963 | 4/1926 | Luger | 108/132 |
| 1,614,539 | 1/1927 | Ryan . | |
| 2,249,455 | 7/1941 | Caldwell . | |
| 2,258,133 | 10/1941 | Chuma . | |
| 2,278,817 | 4/1942 | Zeindler . | |
| 2,368,748 | 2/1945 | Doty . | |
| 2,508,627 | 5/1950 | Spiegel et al. . | |
| 2,514,524 | 7/1950 | Steele . | |
| 2,621,095 | 12/1952 | Haumerson . | |
| 2,645,539 | 7/1953 | Thompson . | |
| 2,721,778 | 10/1955 | Wilson . | |
| 2,730,417 | 1/1956 | Mitchell . | |
| 2,739,860 | 3/1956 | Wilson . | |
| 2,747,958 | 5/1956 | Wilson . | |
| 2,764,460 | 9/1956 | Nelson | 108/131 |
| 2,766,089 | 10/1956 | Nielsen . | |
| 2,771,937 | 11/1956 | Wilson . | |
| 2,772,424 | 12/1956 | Roche et al. | 5/181 |
| 2,782,075 | 2/1957 | Fagan . | |
| 2,829,019 | 4/1958 | Haven et al. | 108/131 |
| 2,831,741 | 4/1958 | Wilson . | |
| 2,873,157 | 2/1959 | Wilson . | |
| 2,887,348 | 5/1959 | Sadowsky . | |
| 2,969,245 | 1/1961 | Wilson . | |
| 2,977,169 | 3/1961 | Geller . | |
| 2,978,754 | 4/1961 | Wilson . | |
| 2,983,968 | 5/1961 | Wurn . | |
| 2,993,740 | 7/1961 | Good . | |
| 3,027,209 | 3/1962 | Nielsen . | |
| 3,028,197 | 4/1962 | Wilson . | |
| 3,034,843 | 5/1962 | Moon . | |
| 3,075,809 | 1/1963 | Wilson . | |
| 3,080,833 | 3/1963 | Risdall . | |
| 3,099,480 | 7/1963 | Wilson . | |
| 3,123,837 | 3/1964 | Paine et al. | 5/181 |
| 3,143,982 | 8/1964 | Blink et al. . | |

(List continued on next page.)

FOREIGN PATENT DOCUMENTS

| | | |
|---|---|---|
| 0 389 932 | 3/1990 | European Pat. Off. . |
| 84 28 611 | 1/1986 | Germany . |

OTHER PUBLICATIONS

"Sico Staging & Risers . . . Leading the Way." 4 Page Brochure by Sico Incorporated.

*Primary Examiner*—Peter M. Cuomo
*Assistant Examiner*—Anthony D. Barfield
*Attorney, Agent, or Firm*—Merchant, Gould, Smith, Edell, Welter & Schmidt

[57] ABSTRACT

A folding framework (18) for a ramp section (12) includes folding legs (20). The legs include extendable members (24) extending between the sets of legs with an inner sliding member (28) and a outer sliding member (26) providing for folding motion. The sets of legs (20) both fold inward to a storage position wherein extendable members (24) and the legs (20) lie substantially flat against the underside of a supportive deck (14). The extendable members (24) include an angled end portion (32) which extend downward and pivotally mount to the legs (20) for offsetting the extendable members (24) from the legs (20) when in the folded position.

14 Claims, 3 Drawing Sheets

U.S. PATENT DOCUMENTS 3,245,363 4/1966 Amthor, Jr. .
3,276,401 10/1966 Wilson et al. .
3,337,262 8/1967 Katzfey et al. .
3,351,029 11/1967 Bue .
3,437,058 4/1969 Bue .
3,476,061 11/1969 Takahashi .
3,557,720 1/1971 Blink et al. .
3,799,073 3/1974 Nielsen .
3,861,325 1/1975 Bue et al. .
3,871,039 3/1975 Gatceau et al. ..... 5/181
3,903,812 9/1975 Cowley .
3,999,491 12/1976 Wilson .
4,026,221 5/1977 Wilson et al. .
4,054,096 10/1977 Wilson et al. .
4,074,636 2/1978 Wilson .
4,104,835 8/1978 Bardwick, III .
4,133,271 1/1979 Carlson .
4,232,488 11/1980 Hanley .
4,327,650 5/1982 Bue .
4,570,751 2/1986 Kleu .
4,590,865 5/1986 Rütsche et al. .
4,615,279 10/1986 de la Haye .
4,627,364 12/1986 Klein et al. .
4,638,604 1/1987 Rogers et al. .
4,779,542 10/1988 Staten et al. .
4,779,878 10/1988 Betts et al. .
4,811,530 3/1989 Eyerly .
4,833,998 5/1989 Everett et al. ..... 108/132
4,863,126 9/1989 Rogers et al. .
4,872,295 10/1989 Fujita .
4,917,217 4/1990 Rogers et al. .
4,934,113 6/1990 Hall et al. .
4,949,649 8/1990 Terres et al. .
4,979,340 12/1990 Wilson et al. .
5,050,353 9/1991 Rogers et al. .
5,367,963 11/1994 Jaggi et al. .

FOLDING FRAMEWORK AND SUPPORT LEGS

BACKGROUND OF THE INVENTION

1. Field of the Invention

The present invention relates to a folding framework, and in particular to a folding framework for support legs that fold toward one another.

2. Description of the Prior Art

Folding frameworks are widely known in the art and are used for many applications such as for folding stages, tables, platforms, and other applications which require a deck or planar member to be supported. The frameworks provide an elevated supported surface and provide for folding to a storage position wherein the device requires less storage space. Although prior folding linkages have provided for folding to a narrower profile for the stage or other device, still further improvements are possible.

It can be appreciated that it is preferable to have the entire linkage mount against the underside of a deck and to fold to a substantially flattened position nesting within a framework for the deck. It can further be appreciated that it is preferable to have two sets of legs folding towards one another to provide a more stable support system when the legs are in the extended use position near the edges of the decking, while still folding to a flat storage position.

It can be appreciated that in addition to stages, tables and other platforms, ramps also need support, and it is preferable to have a folding support framework which may be folded against the underside of the ramp. However, the angle of the deck relative to the legs adds special problems and makes it more difficult to adapt to a folding linkage. In addition, the legs require different lengths between the opposed ends of the ramp, complicating the configuration of a folding linkage.

Such a folding framework should provide a folding linkage which is simple and provides easy and dependable operation. The linkage should also use standard elements which may be easily and cheaply manufactured.

It can be seen then that a device is needed which provides a folding framework for a supported structure with sets of support legs that fold toward one another. It can also be appreciated that such a device should provide for folding to a storage position with the legs and linkage members lying substantially flat against the underside of the supported surface. The linkage should also provide sturdy support for the legs and provide for supporting angled deck surfaces. The present invention addresses these as well as other problems associated with folding frameworks.

SUMMARY OF THE INVENTION

The present invention is directed to a folding framework for a deck or other supported structure. The folding framework connects to a stationary framework and includes legs extending downward from the framework. The supported surface may be angled, thereby requiring a first set of legs having a first height and a second set of legs having a different height. The folding framework includes extendable braces extending between the sets of legs with members slidably telescoping relative to one another. The members are lockable with a spring-loaded pin or other device to lock the folding framework in the stored or use positions. The telescoping members include angled end portions and extending downward from the extensible members and pivotally connecting to legs. This configuration provides for offsetting the legs above the telescoping members when in the folded storage position.

The sets of legs fold inward and the extendable braces shorten when in the folded storage position. In the storage position, the framework for the legs is folded substantially flat against the underside of the supported deck. The legs mount to the deck and stationary framework on a mounting member. The legs include a stop which is angled to locate the leg in the use position, to support the deck at the proper inclined angle.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
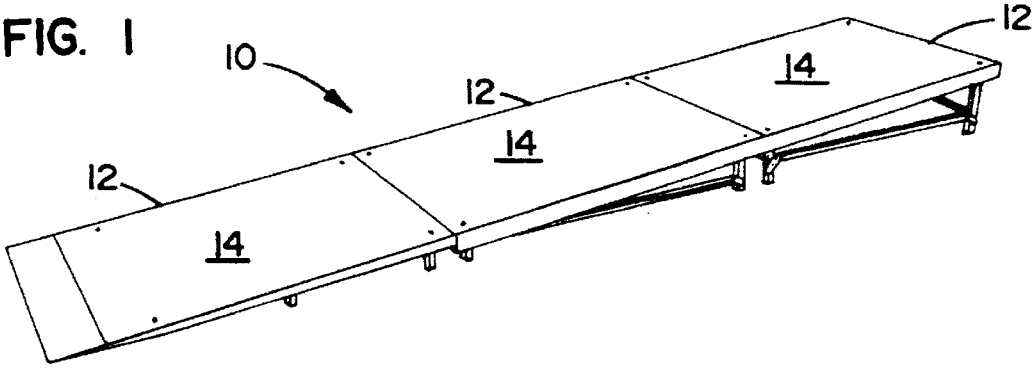
FIG. 1 shows a perspective view of a ramp apparatus including ramp sections having leg support structures according to the principles of the present invention.

Referring now to the drawings, and in particular to FIG. 1, there is shown a ramp, generally designated 10. The ramp 10 includes several ramp sections 12 of increasing heights to form a ramping surface from the ground to an elevated level. The ramp 10 is configured to attach to an elevated stage or platform to provide a gradual sloping surface.

Figure 2:
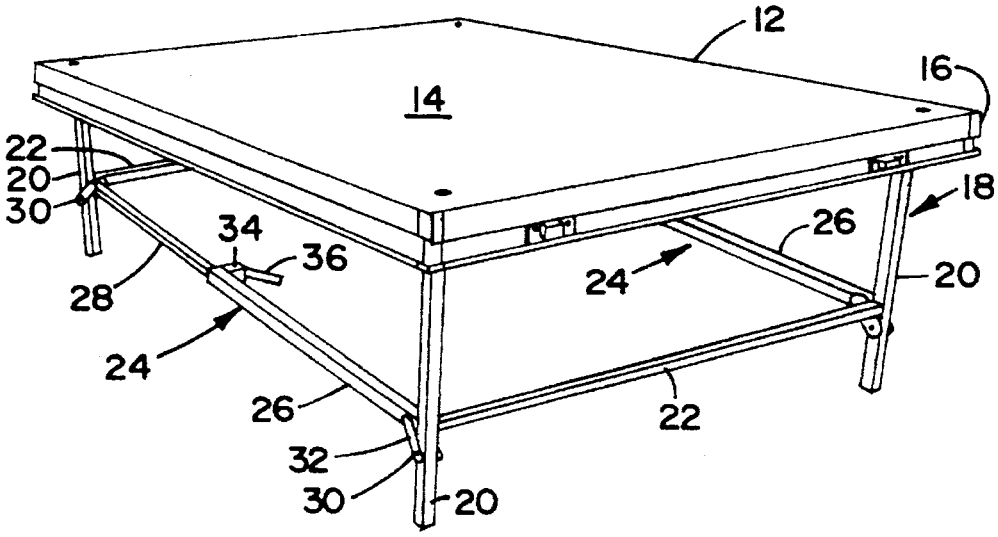
FIG. 2 shows a perspective view of a ramp section for the ramp sheen in FIG. 1 having a folding framework according to the principles of the present invention.

As shown more clearly in FIG. 2, each of the ramp sections 12 includes a deck 14 having a stationary framework 16. The framework 16 is configured for attaching the ramp sections 12 together to form a continuous surface and for attaching to a platform or elevated stage. Below the deck framework 16 of each of the higher sections 12 is a folding framework 18, including support legs 20. The legs 20 are two different lengths to accommodate the incline of the ramp section 12 and each pair of legs 20 includes cross members 22 extending therebetween. In addition, two extensible braces 24 extend between the two sets of legs 20. It can be appreciated that for the ramp to angle, the legs 20 must have two different lengths with the framework 18 capable of folding the different length sets of legs 20. However, it can be appreciated that the present invention may also use a folding framework 18 which may be utilized with non-ramping surfaces. Moreover, although in the embodiment shown, the ramp 10 extends upward at an angle α of approximately five degrees, lesser or greater angles may also be utilized.

Figure 3:
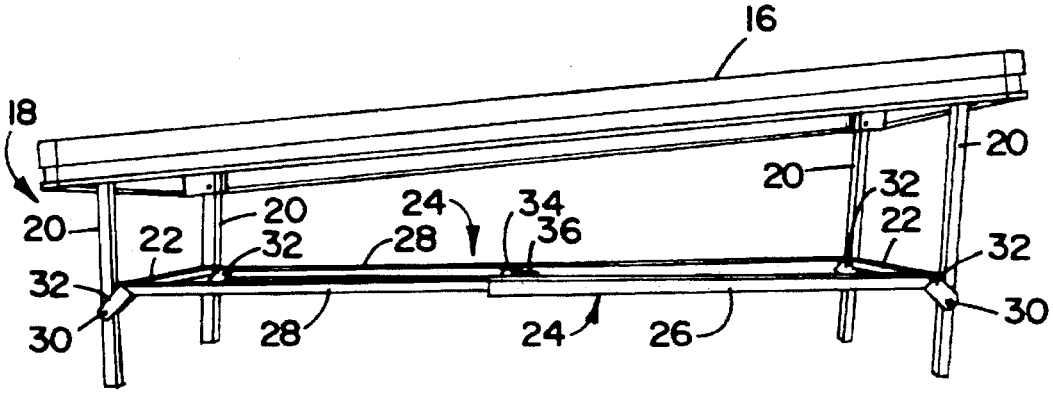
FIG. 3 shows a side elevational view of the ramp section and folding framework shown in FIG. 2, with the frame in an unfolded use position.
Figure 4:
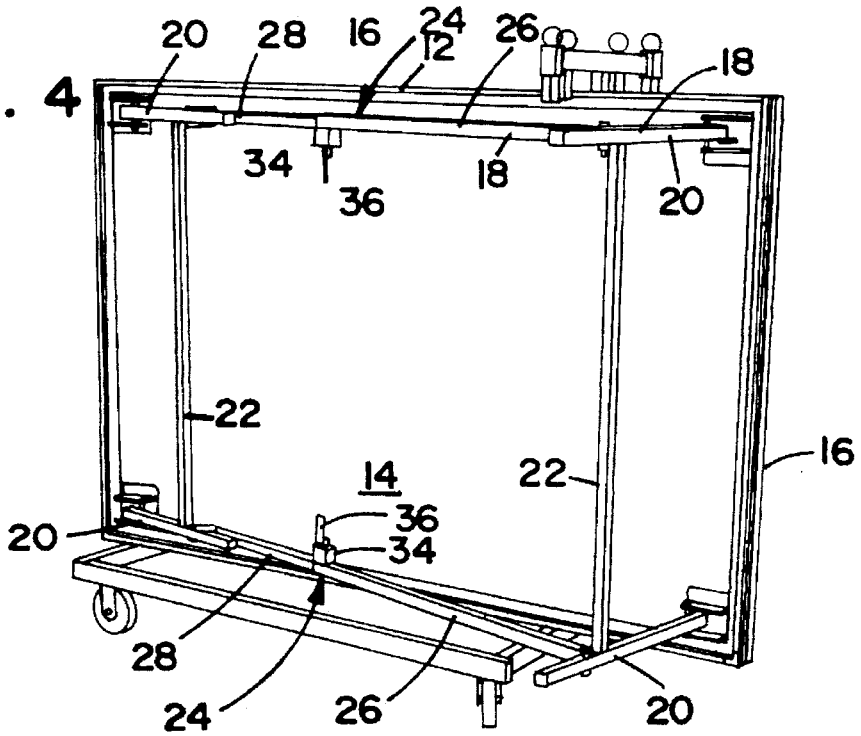
FIG. 4 shows a perspective view of the underside of the ramp section shown in FIG. 2 with the frame in a partially folded position.
Figure 5:
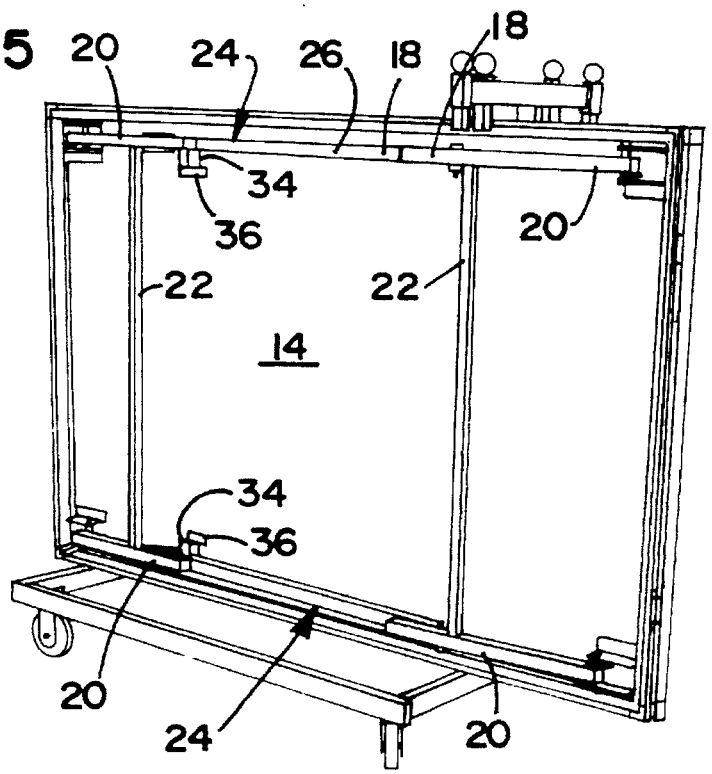
FIG. 5 shows a perspective view of the underside of the ramp section shown in FIG. 2 with the frame in a fully folded position for storage.

Referring now to FIGS. 3–5, as shown in FIG. 3, in the unfolded position, the extensible braces 24 include telescoping members 26 and 28 sliding relative to one another. In the embodiment shown, the telescoping members 26 and 28 are locked into place by spring-loaded pins 34 extending through aligned orifices in the telescoping members 26 and 28. The spring-loaded pins 34 include a handle 36 for releasing and inserting the retainer pin 34. In addition, to facilitate folding, at each end of the telescoping members 26 and 28 are angled portions 32. The angled portions extend downward from the ends of the telescoping members 26 and 28 and attach to a pivot pin 30 on the legs 20. The angled portions 32 provide for better folding and storage of the framework 18, as explained hereinafter.

Referring now to FIG. 4, to fold the framework 18 to a storage position, the retainer pins 34 must be released so that the telescoping members 26 and 28 may slide freely relative to one another. When this has been done, one of the sets of legs 20 may be folded inward, thereby decreasing the overall length of the extensible braces 24. After one set of legs 20 has been folded inward, the second set may also be folded inward as shown in FIG. 5. It can be appreciated that in this position, the lowermost portion of the legs 20 overlie the extensible braces 24. The angled portions 32 offset the legs 20 from the extensible members 24 for better folding and storage. To unfold the framework 18, one set of the legs 20 is pulled outward away from the deck 14. The other set of legs 20 is then extended, thereby sliding the telescoping members 26 and 28 outward. The retaining pins 34 align with the orifices in the telescoping members 26 and 28 when fully extended to maintain the framework 18 in the use position shown in FIG. 3.

Figure 6:
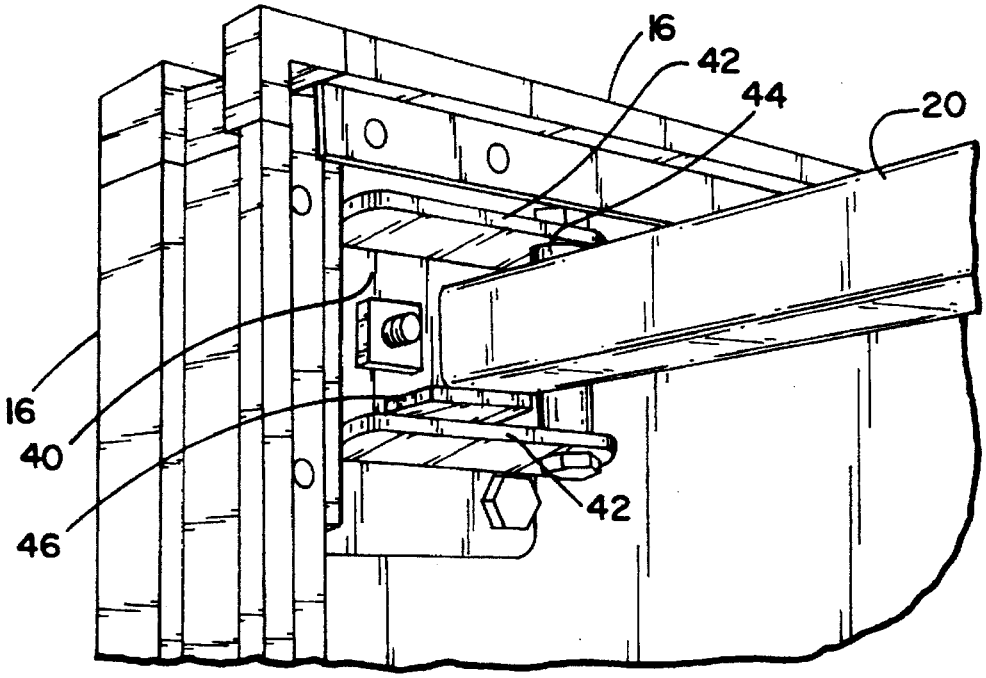
FIG. 6 shows a perspective view of the connection of a leg for the folding framework; and, FIG. 7 shows a side elevational view of the connection for a leg for the folding framework.
Figure 7:
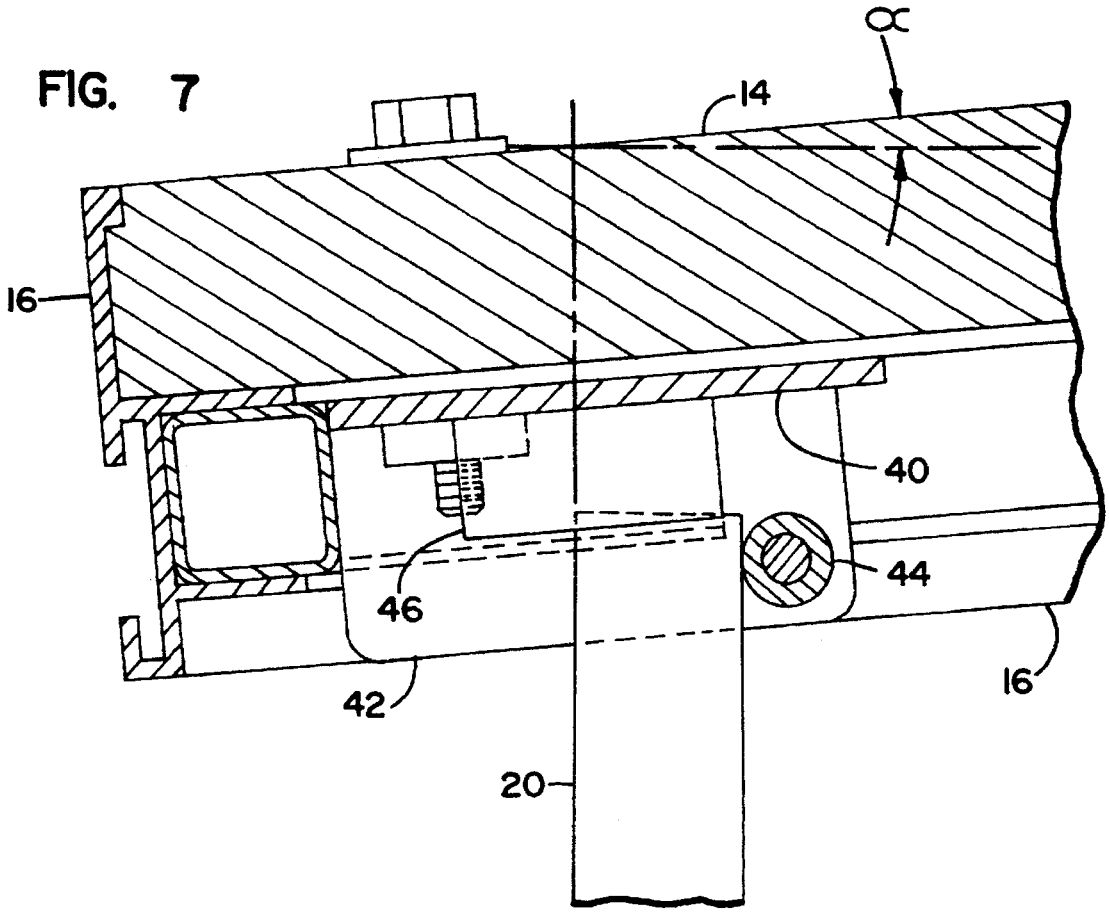

Referring now to FIGS. 6 and 7, the legs 20 connect to the deck 14 and deck framework 16 at mounting members 40. A pivot pin 44 extends through the leg 20 and receiving portions 42 on the mounting member 40 to provide for rotation of the leg 20 and thereby folding of the framework 18. An angled stop 46 mounted on the leg 20 provides for positioning the leg 20 at an angle of α plus 90 degrees relative to the mounting member 40 to maintain the angled deck 14 in the proper position relative to the legs 20. In this manner, the legs 20 remain in a vertical position while the deck is fully supported at its angled position. The stop 46 also limits the rotation to prevent overrotating the legs 20 while allowing the legs 20 to fold inward toward one another.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding support apparatus, for supporting a deck or the like, comprising:

two pairs of folding legs that fold toward each other;

extensible braces extending between corresponding legs of the two pairs and coplanar with the corresponding legs of the two pairs, wherein the extensible braces are substantially perpendicular to the corresponding legs of the two pairs when the two pairs of legs are unfolded, wherein each of the extensible braces includes an angled end portion, extending downward from ends of the braces and pivotally mounting to the legs and wherein each of the extensible braces includes a first section and a second section that slidably telescope together when the folding legs are folded; and a stop associated with each of the folding legs that limits unfolding of the folding legs.

2. A folding support apparatus according to claim 1, wherein the support apparatus includes upper mounting members, and wherein the internal angle between the mounting members and the first pair of legs is greater than 90 degrees and the internal angle between the mounting members and the second pair of legs is less than 90 degrees.

3. The folding support apparatus according to claim 2, wherein the two pairs of legs are of different length.

4. A folding support apparatus according to claim 1, wherein the stops associated with the folding legs are positioned near an upper end of the legs.

5. A folding apparatus according to claim 1, wherein the legs overlie the extensible braces when folded.

6. The folding support apparatus according to claim 1, further comprising a releasable lock attached to one of the extensible braces, securing the extensible brace in an extended position when locked.

7. The folding support apparatus according to claim 1, wherein the second section slides within the first section.

8. The folding support apparatus according to claim 7, further comprising a releasable lock attached to one of the extensible braces, wherein the releasable lock is positioned on the first and second sections of the extensible brace, preventing the second section from sliding within the first section when locked.

9. A folding support apparatus, comprising:

a supported surface having an underside;

two folding legs positioned apart from one another to support the supported surface, pivoting between an extended position and a retracted position, wherein the legs lie substantially flat against the underside of the supported surface in the retracted position;

an extensible brace having a first end attached to one of the legs and a second end attached to the other one of the legs, the extensible brace having a first section and a second section telescoping together and reducing in length when the legs are folded towards the retracted position; and a first angled portion extending downward from the first end of the extensible brace at an angle of less than 90 degrees from a longitudinal axis of the extensible brace and pivotally mounted on one of the legs, and a second angled portion extending downward from the second end of the extensible brace at an angle of less than 90 degrees from the longitudinal axis and pivotally mounted on the other one of the legs.

10. A folding support apparatus according to claim 9, further comprising a stop associated with each of the folding legs, positioned near an upper end of each leg, limiting the extended position of the legs.

11. The folding support apparatus according to claim 9, further comprising a releasable lock attached to the extensible brace, securing the extensible brace in an extended position when locked.

12. The folding support apparatus according to claim 9, wherein the two legs are of different length.

13. The folding support apparatus according to claim 9, wherein the second section slides within the first section.

14. The folding support apparatus according to claim 13, further comprising a releasable lock attached to the extensible brace, wherein the releasable lock is positioned on the first and second sections of the extensible brace, preventing the second section from sliding within the first section when locked.

* * * * *